US012366146B2

(12) United States Patent
Frost et al.

(10) Patent No.: US 12,366,146 B2
(45) Date of Patent: Jul. 22, 2025

(54) TUBING ANCHOR GAS VENT AND ASSOCIATED METHODS AND SYSTEMS

(71) Applicant: ODESSA SEPARATOR, INC., Odessa, TX (US)

(72) Inventors: Cavin B. Frost, Odessa, TX (US); Gustavo A. Gonzalez-Cabrera, Midland, TX (US); Daniel L. Culbertson, Odessa, TX (US)

(73) Assignee: Odessa Separator, Inc., Odessa, TX (US)

( * ) Notice: Subject to any disclaimer, the term of this patent is extended or adjusted under 35 U.S.C. 154(b) by 0 days.

(21) Appl. No.: 17/831,658

(22) Filed: Jun. 3, 2022

(65) Prior Publication Data

US 2022/0397019 A1 Dec. 15, 2022

Related U.S. Application Data

(60) Provisional application No. 63/210,581, filed on Jun. 15, 2021.

(51) Int. Cl.
*E21B 43/12* (2006.01)
*E21B 43/38* (2006.01)

(52) U.S. Cl.
CPC ..... *E21B 43/12* (2013.01); *E21B 43/38* (2013.01)

(58) Field of Classification Search
CPC ..... E21B 43/12; E21B 43/38
See application file for complete search history.

(56) References Cited

U.S. PATENT DOCUMENTS 1,975,390 A * 10/1934 Davic ..... E21B 33/12 166/241.1
2,345,710 A * 4/1944 Lybyer ..... F04B 53/00 166/105.1
2,491,587 A * 12/1949 Seago ..... E21B 43/38 166/54
2,528,448 A * 10/1950 Munk ..... E21B 43/38 166/105.5
2,883,940 A 4/1959 Gibson
3,624,822 A 11/1971 Carle et al.
4,231,767 A 11/1980 Acker
5,154,588 A 10/1992 Freet et al.
(Continued)

FOREIGN PATENT DOCUMENTS

CN 108252685 A * 7/2018 ..... E21B 23/08

OTHER PUBLICATIONS

Odessa Separator, Inc.; "Bypass Valve/ Intake System", company brochure, received Oct. 2, 2016, 1 page.
(Continued)

*Primary Examiner* — D. Andrews
(74) *Attorney, Agent, or Firm* — Smith IP Services, P.C.

(57) ABSTRACT

A gas vent can include an inner production tube and at least two outer housings. One outer housing is configured to be connected above a tubing anchor, and another outer housing is configured to be connected below the tubing anchor. The inner production tube is configured to extend longitudinally through the tubing anchor. A gas vent system can include an inner production tube which extends longitudinally through a tubing anchor, and an annulus formed between the inner production tube and the tubing anchor. A gas flows through an interior of the tubing anchor via the annulus.

12 Claims, 3 Drawing Sheets

(56) References Cited

U.S. PATENT DOCUMENTS

| | | | | |
|---|---|---|---|---|
| 5,411,088 | A | 5/1995 | LeBlanc et al. | |
| 5,482,117 | A | 1/1996 | Kolpak et al. | |
| 5,868,200 | A | 2/1999 | Bryant et al. | |
| 7,104,321 | B2 | 9/2006 | Carruth | |
| 8,881,803 | B1 | 11/2014 | Frost | |
| 10,415,360 | B2 | 9/2019 | Culbertson et al. | |
| 10,570,721 | B1 * | 2/2020 | Raglin | B01D 19/0042 |
| 11,428,091 | B2 | 8/2022 | Frost et al. | |
| 2013/0327528 | A1 | 12/2013 | Frost | |
| 2017/0356280 | A1 * | 12/2017 | Sylvester | E21B 43/38 |
| 2020/0284134 | A1 * | 9/2020 | Raglin | E21B 43/38 |

OTHER PUBLICATIONS

Odessa Separator, Inc.; "Dual Body Super Gas and Sand Shield", company brochure, received Oct. 2, 2016, 1 page.

Odessa Separator, Inc.; "Gas Shield", company brochure, received Oct. 2, 2016, 1 page.

Odessa Separator, Inc.; "Slotted Gas Shield", company brochure, received Oct. 2, 2016, 1 page.

Odessa Separator, Inc.; "Super Gas and Sand Shield", company brochure, received Oct. 2, 2016, 1 page.

McCoy, J.N., et al.; "Improved Downhole Gas Separators", paper for the department of Petroleum Engineering, dated Apr. 7 & 8, 1998, 11 pages.

* cited by examiner

TUBING ANCHOR GAS VENT AND ASSOCIATED METHODS AND SYSTEMS

CROSS-REFERENCE TO RELATED APPLICATION

This application claims the benefit of the filing date of U.S. provisional application No. 63/210,581 filed on 15 Jun. 2021. The entire disclosure of this prior application is incorporated herein by this reference.

BACKGROUND

This disclosure relates generally to equipment utilized and operations performed in conjunction with a subterranean well and, in an example described below, more particularly provides a gas vent for use with a tubing anchor in a well.

Fluids produced from a well often includes both gas and liquids (such as, oil, water, gas condensates, etc.). If the gas is not disposed of downhole, the liquids are typically most efficiently produced if the gas is also produced from the well. For example, if the gas is allowed to accumulate downhole, it may eventually interfere with operation of a downhole pump.

Therefore, it will be readily appreciated that improvements in the art of producing gas from a well are continually needed. It is among the objects of this disclosure to provide such improvements to the art. The improvements described herein may be used with a variety of different well systems, which may or may not include a downhole pump.

DETAILED DESCRIPTION

Figure 1:
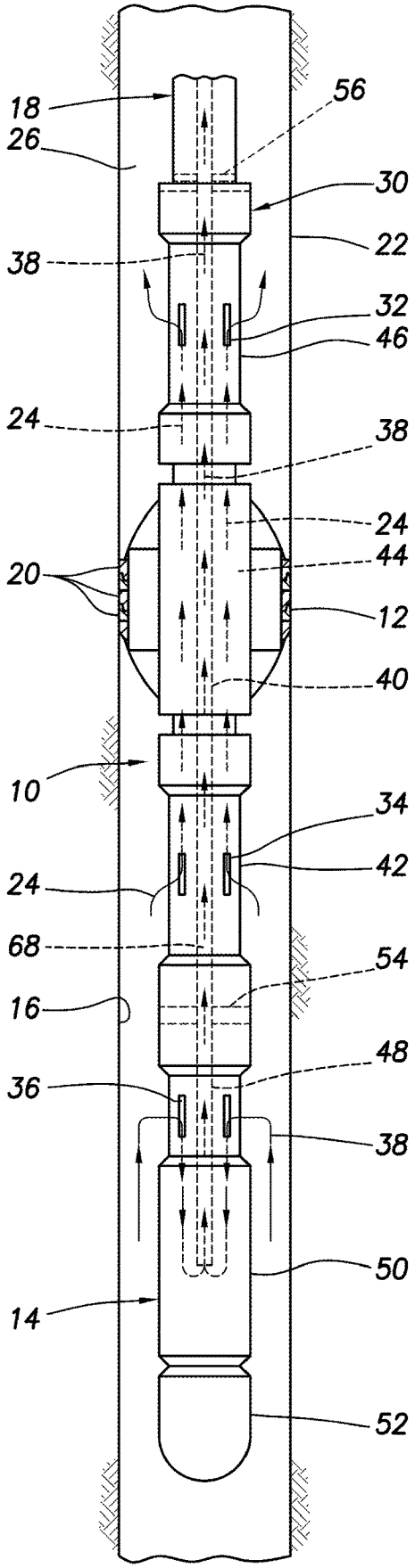
FIG. 1 is a representative partially cross-sectional view of an example of a well system and associated method which can embody principles of this disclosure.

Representatively illustrated in FIG. 1 is a gas vent system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

The FIG. 1 system 10 is designed for use with a tubing anchor 12 for securing a bottom hole assembly 14 in a wellbore 16. In this example, the tubing anchor 12 allows tension to be maintained in a tubular string 18 extending to the surface, thereby preventing movement of the tubular string. If a reciprocating rod pump (not shown) is included in the tubular string 18, movement of the tubular string could result in rod and tubing wear, or pump damage. The tubing anchor 12 in this example can also prevent the tubular string 18 from falling down the wellbore in the event of breakage.

The tubing anchor 12 may be set by rotation of the tubular string 18 at the surface, so that slips 20 extend outward and make contact with liner, pipe or casing 22 that lines the wellbore 16. It is released by pulling upward on the tubular string 18 to shear one or more shear pins (not shown) of the tubing anchor 12. In other examples, other types of tubing anchors may be used. The scope of this disclosure is not limited to any particular details of the tubing anchor 12 as described herein or depicted in the drawings.

Because the tubing anchor 12 is one of the largest diameter elements of the bottom hole assembly 14, it can restrict the flow of gas 24 through an annulus 26 formed radially between the tubular string 18 and the well casing 22. This can reduce well production and, thus, an operator's profit.

The FIG. 1 system 10 includes a gas vent 30 connected in the tubular string 18, in order to provide additional area for gas 24 to rise unrestricted past the tubing anchor 12. The gas vent 30 includes openings or ports 32, 34 above and below the tubing anchor 12, which provide a secondary pathway for gas 24 flow through the gas vent. Lower slotted ports 36 provide a passageway for liquids 38, which are routed through an inner production tube 40 and upward through the tubular string 18 to the surface.

The less dense gas 24 is received into the ports 34 (which are uphole relative to the ports 36), then flows upwardly through a tubular outer housing 42 of the gas vent 30, and through the tubing anchor 12 up to the upper vent ports 32. The gas 24 exits through the top vent ports 32 and rises up the annulus 26 to the surface.

As with a conventional tubing anchor installation, the gas 24 will also flow through the annulus 26 around the tubing anchor 12, although this flow may be substantially restricted by the tubing anchor. The gas vent 30 provides more open area to accommodate higher rates of gas flow. Production rates are increased, compared to conventional tubing anchor installations.

In the FIG. 1 gas vent 30 example, the inner production tube 40 extends longitudinally through the tubing anchor 12, thereby forming an annulus 44 between the inner production tube and one or more outer tubular bodies or housings 42, 46. Thus, the gas 24 can flow through the tubing anchor 12 via the annulus 44.

The liquid 38 flows through the tubing anchor 12 via an inner flow passage 68 of the inner production tube 40. The inner production tube 40 extends through two outer housings 42, 46 of the gas vent 30. The tubing anchor 12 is connected between the outer housings 42, 46.

Each of the outer housings 42, 46 has respective openings or ports 34, 32 that permit fluid communication between the annulus 44 and an exterior of the respective outer housing. In the FIG. 1 system 10, the ports 32, 34 permit flow between the annulus 26 and the annulus 44.

As depicted in FIG. 1, a lower end of the inner production tube 40 comprises a dip tube 48 positioned in a tubular outer housing 50 having the openings or ports 36 that permit fluid communication between an interior and an exterior of the housing 50. The openings or ports 36 are positioned vertically higher than a lower end of the dip tube 48.

A bull plug 52 closes off a lower end of the outer housing 50. A seal 54 blocks flow through the annulus 44 between the outer housings 42, 50. Another seal 56 blocks flow through the annulus 44 at an upper end of the outer housing 46. The seals 54, 56 may be any type of seals capable of preventing flow between the inner production tube 40 and each of the outer housings 42, 46, 50 (for example, silicone sealant, o-rings, chevron seals, metal-to-metal seals, tapered threads, etc.).

Figure 2:
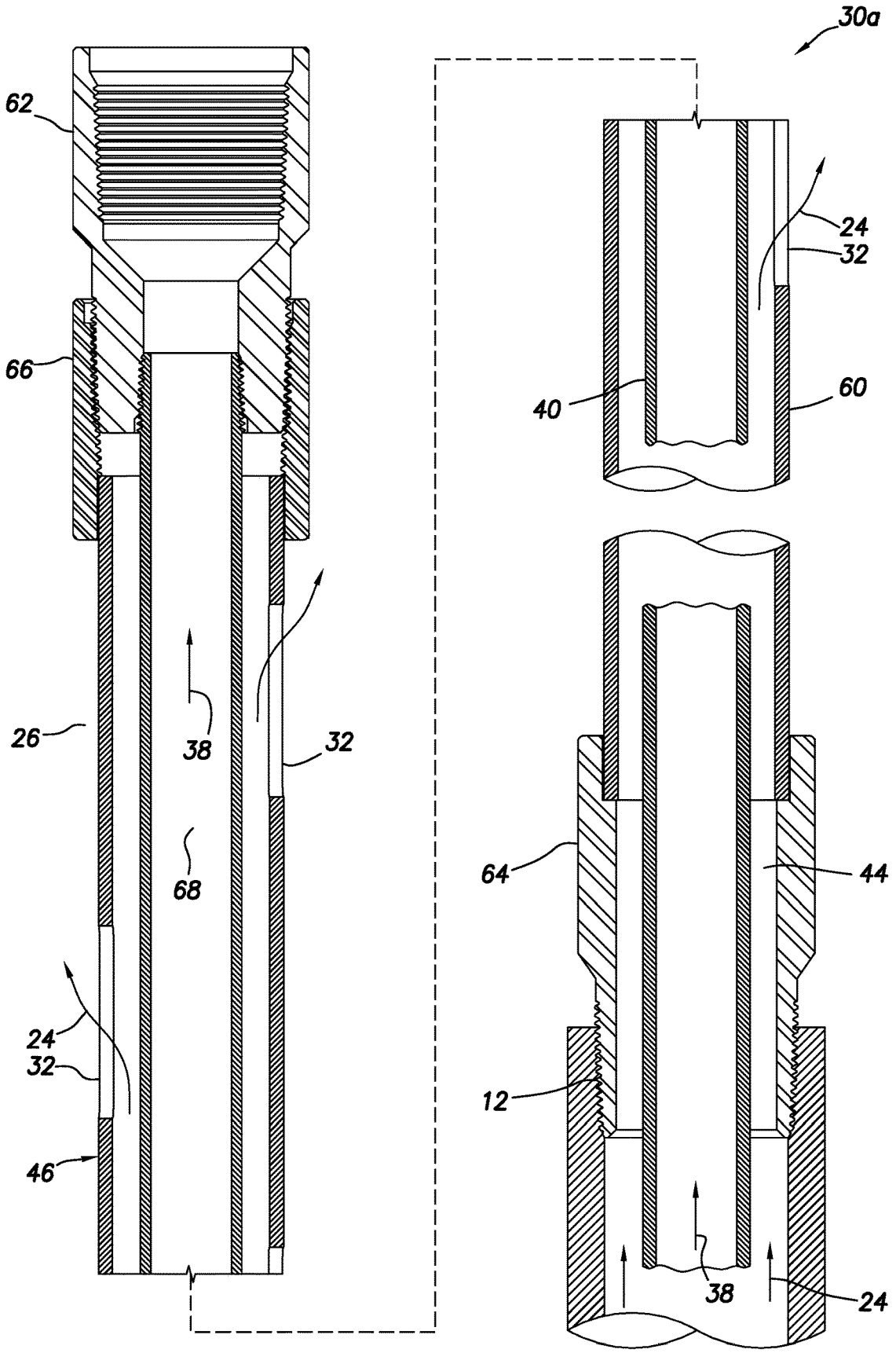
FIG. 2 is a representative cross-sectional view of an example of an upper portion of a gas vent which may be used with the FIG. 1 system and method.
Figure 3:
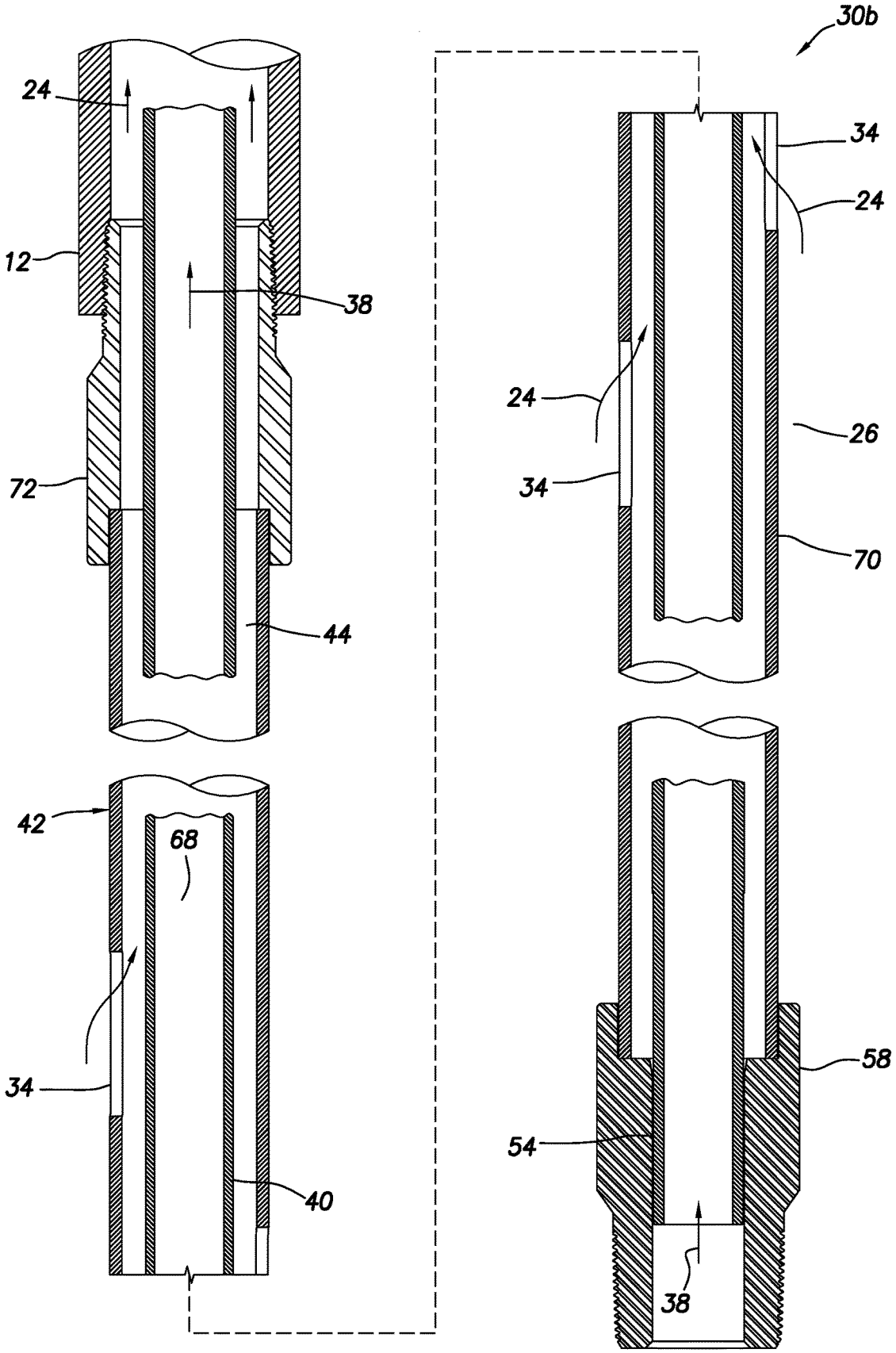
FIG. 3 is a representative cross-sectional view of an example of a lower portion of the gas vent.

Referring additionally now to FIGS. 2 & 3, more detailed partially cross-sectional views of respective upper and lower portions 30*a*, 30*b* of an example of the gas vent 30 are representatively illustrated. In the FIG. 1 system 10, the gas vent upper portion 30*a* is connected above the tubing anchor 12, and the gas vent lower portion 30*b* is connected below the tubing anchor.

The outer housing 50 and lower dip tube 48 section (see FIG. 1) of the inner production tube 40 are not depicted in FIG. 3. However, it will be appreciated that the inner production tube 40 can be extended downwardly through a lower connector 58 (or another section of the inner production tube could be connected to the lower connector), and extend into the outer housing 50 below the lower connector as depicted in FIG. 1. Liquids 38 can flow into the ports 36 in the outer housing 50 and then flow upwardly into the dip tube 48 and the remainder of the inner production tube 40 via the flow passage 68.

In the FIG. 2 example, the outer housing 46 includes a generally tubular body 60 with an upper threaded connector 62 connected at an upper end of the body, and a lower threaded connector 64 connected at a lower end of the body. The ports 32 are formed through the body 60, thereby permitting fluid communication between the annulus 26 and the annulus 44.

The upper connector 62 is configured to connect the upper portion 30*a* of the gas vent to the remainder of the tubular string 18 above the gas vent (see FIG. 1). The lower connector 64 is configured to connect the upper portion 30*a* of the gas vent to an upper end of the tubing anchor 12 (although there may be tubing connected between the lower connector and the tubing anchor).

In this example, the lower end of the body 60 is welded to an upper end of the lower connector 64. The upper end of the body 60 is welded to a lower end of a collar 66, which is threaded to a lower end of the upper connector 62. The threads on the upper connector 62 and in the collar 66 are tapered, so that they effectively block flow through the upper end of the annulus 44.

An upper end of the inner production tube 40 is threaded into the lower end of the upper connector 62. The threads are tapered, so that fluid communication between the annulus 44 and an inner flow passage 68 of the inner production tube 40 is effectively blocked.

In the FIG. 3 example, the outer housing 42 includes a generally tubular body 70 with an upper threaded connector 72 connected at an upper end of the body, and the lower threaded connector 58 connected at a lower end of the body. The ports 34 are formed through the body 70, thereby permitting fluid communication between the annulus 26 and the annulus 44.

The upper connector 72 is configured to connect the lower portion 30*b* of the gas vent to a lower end of the tubing anchor 12 (although there may be tubing connected between the upper connector and the tubing anchor). The lower connector 58 is configured to connect the lower portion 30*b* of the gas vent to the remainder of the bottom hole assembly 14 below the gas vent (e.g., including the dip tube 48 and outer housing 50; see FIG. 1).

In this example, the lower end of the body 70 is welded to an upper end of the lower connector 58. The upper end of the body 70 is welded to a lower end of the upper connector 72. The threads on the upper connector 72 are tapered, so that they effectively block flow between the annulus 26 and the annulus 44.

A lower end of the inner production tube 40 is slidingly received in a bore of the lower connector 58. A radial gap between the inner production tube 40 and the bore of the lower connector 58 is relatively small, so that a sealant placed in the gap can form an effective seal 54, which blocks flow through the lower end of the annulus 44.

Thus, the annulus 44 extends longitudinally through the tubing anchor 12 and is blocked at its upper end in the upper gas vent portion 30*a*, and at its lower end in the lower gas vent portion 30*b*. Gas 24 can enter the ports 34 in the body 70, the gas can flow upwardly through the annulus 44, and then the gas can exit the ports 32 in the body 60.

The liquids 38 can enter the flow passage 68 via the lower connector 58 and flow upwardly through the inner production tube 40 to the upper connector 62. The inner production tube 40 is sealed at its opposite ends from fluid communication with the annulus 44. Both of the annulus 44 and the inner production tube 40 extend longitudinally through the tubing anchor 12 between the upper and lower portions 30*a,b* of the gas vent.

Although each of the inner production tube 40 and the bodies 60, 70 is depicted in the drawings as comprising a single tube, it will be appreciated that multiple tubes could be used for any of these elements. Welds, threads, seals, etc., depicted in the drawings and/or described herein may be replaced by other types of connections or seals. Thus, the scope of this disclosure is not limited to any specific details of the gas vent upper and lower portions 30*a,b* depicted in the drawings or described herein.

It may now be fully appreciated that the above disclosure provides significant advancements to the art of producing gas from a well. By forming the annulus 44 and extending it through an interior of the tubing anchor 12, additional area for flow of the gas 24 past the tubing anchor is provided.

A gas vent system 10 for use with a subterranean well is provided to the art by the above disclosure. In one example, the gas vent system 10 can include an inner production tube 40 which extends longitudinally through a tubing anchor 12. An annulus 44 is formed between the inner production tube 40 and the tubing anchor 12. A gas 24 flows through an interior of the tubing anchor 12 via the annulus 44. A liquid 38 may flow through an inner flow passage 68 of the inner production tube 40.

The gas vent system 10 may include an upper gas vent portion 30*a* connected above the tubing anchor 12. The upper gas vent portion 30*a* may include an outer housing 46 having ports 32 formed therein which permit fluid communication between the annulus 44 and an exterior of the upper gas vent portion 30*a*.

The annulus 44 may extend between the outer housing 46 and the inner production tube 40 in the upper gas vent portion 30*a*. Flow through an upper end of the annulus 44 may be blocked in the upper gas vent portion 30*a*.

The gas vent system 10 may include a lower gas vent portion 30*b* connected below the tubing anchor 12. The lower gas vent portion 30*b* may include an outer housing 42 having ports 34 formed therein which permit fluid communication between the annulus 44 and an exterior of the lower gas vent portion 30*b*.

The annulus 44 may extend between the outer housing 42 and the inner production tube 40 in the lower gas vent portion 30*b*. Flow through a lower end of the annulus 44 may be blocked in the lower gas vent portion 30*b*.

A lower end of the inner production tube 40 may comprise a dip tube 48 positioned in an outer housing 50 having ports 36 that permit fluid communication between an interior and an exterior of the outer housing 50. The ports 36 may be positioned vertically higher than a lower end of the dip tube 48.

The annulus 44 may be in fluid communication with an exterior of an outer housing 42 or 46 connected to the tubing anchor 12. The inner production tube 40 is positioned in the outer housing 42, 46 so that the annulus 44 is formed between the inner production tube 40 and the outer housing 42, 46.

A gas vent 30 for use with a subterranean well is also provided to the art by the above disclosure. In one example, the gas vent 30 can include an inner production tube 40, a first outer housing 46, and a second outer housing 42. The first outer housing 46 is configured to be connected above a tubing anchor 12. The second outer housing 42 is configured to be connected below the tubing anchor 12. The inner production tube 40 is configured to extend longitudinally through the tubing anchor 12.

The first outer housing 46 may include a tubular body 60 and ports 32 that permit fluid communication between an exterior of the first outer housing 46 and an annulus 44 formed between the inner production tubing 40 and the body 60. An upper end of the annulus 44 may be sealed off in the first outer housing 46. The inner production tube 40 may be sealingly connected with an upper connector 62 of the first outer housing 46.

The second outer housing 42 may include a tubular body 70 and ports 34 that permit fluid communication between an exterior of the second outer housing 42 and an annulus 44 formed between the inner production tubing 40 and the body 70. A lower end of the annulus 44 may be sealed off in the second outer housing 42. The inner production tube 40 may be sealingly connected with a lower connector 58 of the second outer housing 42.

The first outer housing 46 may include a lower connector 64 that is configured for threaded connection with an upper end of the tubing anchor 12. The second outer housing 42 may include an upper connector 72 that is configured for threaded connection with a lower end of the tubing anchor 12.

An annulus 44 may surround the inner production tube 40. Flow through an upper end of the annulus 44 may be prevented by a sealed connection between the inner production tube 40 and an upper connector 62 of the first outer housing 46. Flow through a lower end of the annulus 44 may be prevented by a sealed connection between the inner production tube 40 and a lower connector 58 of the second outer housing 42.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A gas vent system for use with a subterranean well, the gas vent system comprising:

an upper gas vent portion connected above a tubing anchor, in which the upper gas vent portion comprises a first outer housing;

a lower gas vent portion connected below the tubing anchor, in which the lower gas vent portion comprises a second outer housing;

an inner production tube which extends longitudinally through the tubing anchor and the first and second outer housings, in which a lower end of the inner production tube comprises a dip tube, and in which a lower end of the dip tube is positioned below a fluid inlet of a third outer housing, whereby a gas is separated from a liquid prior to the liquid entering the dip tube; and an annulus formed between the inner production tube and the tubing anchor, in which the annulus extends between the first outer housing and the inner production tube in the upper gas vent portion, in which flow through an upper end of the annulus is blocked in the upper gas vent portion, in which the annulus extends between the second outer housing and the inner production tube in the lower gas vent portion, in which flow through a lower end of the annulus is blocked in the lower gas vent portion, and in which the gas flows upwardly through an interior of the tubing anchor via the annulus.

2. The gas vent system of claim 1, in which a liquid flows upwardly through the inner production tube via an inner flow passage.

3. The gas vent system of claim 1, in which the first outer housing comprises ports formed therein which permit fluid communication between the annulus and an exterior of the upper gas vent portion.

4. The gas vent system of claim 1, in which the second outer housing comprises ports formed therein which permit fluid communication between the annulus and an exterior of the lower gas vent portion.

5. The gas vent system of claim 4, in which the ports are positioned vertically higher than a lower end of the dip tube.

6. A gas vent for use with a subterranean well, the gas vent comprising:

an inner production tube;

a first outer housing configured to be connected above a tubing anchor; and a second outer housing configured to be connected below the tubing anchor, in which the inner production tube is configured to extend longitudinally through the tubing anchor and the first and second housings, in which a lower end of the inner production tube comprises a dip tube, in which a lower end of the dip tube is positioned below a fluid inlet of a third outer housing, whereby a gas is separated from a liquid prior to the liquid entering the dip tube, in which an annulus is formed between the inner production tube and the tubing anchor, in which the annulus extends between the inner production tube and the first and second outer housings, in which an upper end of the annulus is sealed off in the first outer housing, in which a lower end of the annulus is sealed off in the second outer housing, and in which the gas is vented from an exterior of the second outer housing, through the tubing anchor via the annulus, to an exterior of the first outer housing.

7. The gas vent of claim 6, in which the first outer housing comprises a tubular body and ports that permit fluid communication between an exterior of the first outer housing and the annulus formed between the inner production tubing and the body.

8. The gas vent of claim 6, in which the inner production tube is sealingly connected with an upper connector of the first outer housing.

9. The gas vent of claim 6, in which the second outer housing comprises a tubular body and ports that permit fluid communication between an exterior of the second outer housing and the annulus formed between the inner production tubing and the body.

10. The gas vent of claim 6, in which the inner production tube is sealingly connected with a lower connector of the second outer housing.

11. The gas vent of claim 6, in which the first outer housing comprises a lower connector that is configured for threaded connection with an upper end of the tubing anchor.

12. The gas vent of claim 6, in which the second outer housing comprises an upper connector that is configured for threaded connection with a lower end of the tubing anchor.

* * * * *